United States Patent [19]

Yamamoto et al.

[11] Patent Number: 4,601,875

[45] Date of Patent: Jul. 22, 1986

[54] PROCESS FOR PRODUCING MAGNETIC MATERIALS

[75] Inventors: Hitoshi Yamamoto, Osaka; Masato Sagawa, Nagaokakyo; Setsuo Fujimura, Kyoto; Yutaka Matsuura, Ibaraki, all of Japan

[73] Assignee: Sumitomo Special Metals Co., Ltd., Osaka, Japan

[21] Appl. No.: 532,471

[22] Filed: Sep. 15, 1983

[30] Foreign Application Priority Data

| | | | |
|---|---|---|---|
| May 25, 1983 | [JP] | Japan | 58-90801 |
| May 25, 1983 | [JP] | Japan | 58-90802 |
| May 27, 1983 | [JP] | Japan | 58-92237 |
| May 27, 1983 | [JP] | Japan | 58-92238 |
| Sep. 2, 1983 | [JP] | Japan | 58-161626 |
| Sep. 2, 1983 | [JP] | Japan | 58-161627 |

[51] Int. Cl.[4] ..... B22F 3/16; C22C 33/02; C22C 38/32

[52] U.S. Cl. ..... 419/23; 29/608; 75/244; 419/10; 419/12; 419/29; 419/38; 419/48; 419/53; 419/54; 419/57

[58] Field of Search ..... 419/12, 29, 38, 53, 419/57, 23, 54, 10; 75/244; 29/608; 148/105

[56] References Cited

U.S. PATENT DOCUMENTS

| | | | |
|---|---|---|---|
| 2,167,240 | 7/1939 | Hensel | 419/29 |
| 3,684,593 | 8/1972 | Benz et al. | 419/29 |
| 4,401,482 | 8/1983 | Green et al. | 419/38 |
| 4,402,770 | 9/1983 | Koon . | |
| 4,533,408 | 8/1985 | Koon . | |

FOREIGN PATENT DOCUMENTS

| | | |
|---|---|---|
| 2335540 | 1/1974 | Fed. Rep. of Germany . |
| 2705384 | 9/1977 | Fed. Rep. of Germany . |
| 50-1397 | 1/1975 | Japan . |
| 52-50598 | 4/1977 | Japan . |
| 53-28018 | 3/1978 | Japan . |
| 54-76419 | 6/1979 | Japan . |
| 55-113304 | 9/1980 | Japan . |
| 55-115304 | 9/1980 | Japan . |
| 56-29639 | 3/1981 | Japan . |
| 56-47538 | 4/1981 | Japan . |
| 56-47542 | 4/1981 | Japan . |
| 56-116844 | 9/1981 | Japan . |
| 58-123853 | 7/1982 | Japan . |
| 57-141901 | 9/1982 | Japan . |
| 574159 | 3/1976 | Switzerland . |
| 734597 | 8/1955 | United Kingdom . |
| 2021147 | 11/1979 | United Kingdom . |
| 2100286 | 12/1982 | United Kingdom . |
| 833049091 | 5/1984 | United Kingdom . |

OTHER PUBLICATIONS

Ser. No. 414,936, filed Sep. 3, 1982, Croat.

Ser. No. 508,266, filed Jun. 24, 1983, Croat.

J. J. Croat, "Permanent Magnet Properties of Rapidly Quenched Rare Earth-Iron Alloys", IEEE Trans. Mag., vol. MAG-18, No. 6, Nov., 1982, pp. 1442-1447.

R. K. Mishra, "Microstructure of Melt-Spun Neodymium-Iron-Boron Magnets", International Conference on Magnetism 1985.

Croat, "Pr-Fe and Nd-Fe-Based Materials: A New Class of High-Performance Permanent Magnets", J. Appl. Phys., vol. 55, Mar. 15, 1984, pp. 2078-2082.

Chaban et al., "Ternary Nd, Sm, Gd-Fe-B Systems", LVOV State University, pp. 873-875.

Leamy et al., "The Structure of Co-Cu-Fe-Ce Perma- (List continued on next page.)

*Primary Examiner*—Allan M. Lieberman

*Attorney, Agent, or Firm*—Burns, Doane, Swecker and Mathis

[57] ABSTRACT

Permanent magnetic materials of the Fe-B-R type are produced by:

preparing an metallic powder having a mean particle size of 0.3-80 microns and a composition of, by atomic percent, 8-30% R (rare earth elements), 2-28% B, and the balance Fe, compacting, sintering at a temperature of 900-1200 degrees C., and aging at a temperature ranging from 350 degrees C. to the temperature for sintering. Co and additional elements M (Ti, Ni, Bi, V, Nb, Ta, Cr, Mo, W, Mn, Al, Sb, Ge, Sn, Zr, Hf) may be present.

38 Claims, 3 Drawing Figures

OTHER PUBLICATIONS nent Magnets", IEEE Transactions on Magnetics, vol. MAG-9, No. 3, Sep. 1973, pp. 205-209.

Melton et al., "A Electron Microscope Study of Sm-Co-Cu-Based Magnetic Materials with the $Sm_2Co_7$ Structure", J. Appl. Phys., vol. 48, No. 6, Jun., 1977, pp. 2608-2611.

Senno et al., "Magnetic Properties of Sm-Co-Fe-Cu Alloys for Permanent Magnetic Materials", Japan J. Appl. Phys., vol. 14, (1975), No. 10, pp. 1619-1620.

Croat, "Preparation and Coercive Force of Melt-Spun Pr-Fe Alloys", Appl. Phys. Lett., vol. 37, Dec. 15, 1980, pp. 1096-1098.

Koon et al., "A New Class of Melt Quenched Amorphous Magnetic Alloys", Naval Reseach Lab., Washington, D.C., PACS No. 75.50Kj, 75.60Gm.

Koon et al., "Rare-Earth Transition Metal Exchange Interactions in Amorphous $(Fe_{0.82}B_{0.18})_{0.9}R_xLa_{0.1-x}$ Alloys", J. Appl. Phys., vol. 53, Mar., 1982, pp. 2333-2334.

Koon et al., "Magnetic Properties of Amorphous and Crystallized $(Fe_{0.82}B_{0.18})_{0.9}Tb_{0.05}La_{0.05}$", Appl. Phys. Lett., vol. 39, Nov. 15, 1981, pp. 640-642.

Handbook on the Physics and Chemistry of Rare Earths, vol. 2, Chapter 16, "Amorphous Magnetic Rare Earth Alloys", pp. 259-294.

Sagawa et al., "Permanent Magnet Materials Based on the Rare Earth-Iron-Boron Tetragonal Compounds", The Research Institute for Iron, Steel and Other Metals, Tohoku University, Japan.

Nezu et al., "$Sm_2(Co, Fe, Cu)_{17}$ Permanent Magnet Alloys with Additive Element Hf", pp. 437-449.

Sagawa et al., "New Material for Permanent Magnets on a Base of Nd, and Fe", J. Appl. Phys., vol. 55, Mar. 15, 1984, p. 2083.

Kabacoff et al., "Thermal and Magnetic Properties of Amorphous $Pr_x(fe_{0.8}B_{0.2})_{1-x}$", J. Appl. Phys., vol. 53, Mar., 1982, pp. 2255-2257.

Koon et al., "Crystallization of FeB Alloys with Rare Earth to Produce Hard Magnetic Materials", J. Appl. Phys., vol. 55, Mar. 15, 1984, pp. 2063-2066.

Croat et al., "High-Energy Produce Nd-Fe-B Permanent Magnets", Appl. Phys. Lett., vol. 44, Jan., 1984, pp. 148-149.

Hadjipanayis et al., "New Iron-Rare Earth Base Permanent Magnet Materials", Appl. Phys. Lett., vol. 43, Oct. 15, 1983, pp. 797-799.

El Masry, et al., "Magnetic Moments and Coercive Forces in the Hexagonal Boride Homologous Series $Co_{3n+5}R_{n+1}B_{2n}$ with R=Gd and Sm", pp. 33-37.

Stadelmaier, "Cobalt-Free and Samarium-Free Permanent Magnet Materials Based on an Iron-Rare Earth Boride", Dept. of Materials Eng., N.C. State University, Sep. 1, 1983, pp. 1-9.

Herbst et al., "Relationships Between Crystal Structure and Magnetic Properties in $Nd_2Fe_{14}B$", Phys. Dept., General Motors Res. Lab., pp. 1-10.

Stadelmaier, "The Neodymium-Iron Permanent Magnet Breakthrough", Magnetic Materials Products Assoc., Jan., 1984, pp. 1-15.

Topp, "The Chemistry of the Rare-Earth Elements", Topics in Inorganic and General Chemistry, 1965, pp. 1-12.

El Masry et al., "Substitution of Iron for Cobalt in Rare Earth Boride Permanent Magnets of the Type $Co_{3n+5}Sm_{n+1}B_{2n}$", Dept. of Materials, N.C. State Un., Feb., 1983, pp. 86-88.

El Masry et al., "Phase Equilibria in the Co-Sm-B System", Journal of the Less-Common Metals, vol. 96, Jan., 1984, pp. 165-170.

Robinson, "Powerful New Magnet Material Found", Science, vol. 233, Mar. 2, 1984, pp. 920-922.

Givord et al., "Magnetic Properties and Crystal Structure of $Nd_2Fe_{14}B$", Solid State Comm., vol. 50, No. 6, Feb., 1984, pp. 497-499.

Nagel et al., "Influence of Cu-Content on the Hard Magnetic Properties of Sm(co,Cu) 2:17 Compounds", IEEE Transactions on Magnetics, vol. MAG-14, No. 5, Sep. 1978, pp. 671-673.

Ojima et al., "Magnetic Properties of a New Type of Rare-Earth Cobalt Magnets: $Sm_2(CO,Cu,Fe,M)_{17}$", IEEE Transactions on Magnetics, vol. MG-13, No. 5, Sep., 1977, pp. 1317-1319.

Gupta et al., "Magnetization Process and Reversal in $Sm_3Co_{11}B_4$", Journal of Magnetism and Magnetic Materials, vol. 40, 1983, pp. 32-36.

Chikazumi, "Physics of Magnetism", pp. 18, 498-499.

Mainichi Daily News, Saturday, Jun. 4, 1983, "Strongest Magnet Unveiled".

Japanese High Technology, Aug. 1984, vol. 4, No. 5. "Neomax—Neodimium Iron Magnet—", Sumitomo Special Metals Co., Ltd.

Hadjipanayis et al., "Investigation of Crystalline Iron—Platinum Nickel and Amorphous Rare-Earth Alloys for Permanent Magnets", Mar. 15, 1983, pp. 1-79 w/Appendix.

Koo, "Partial Substitution of Sm with Neodymium, Praseodymium, and Mischmetal in $RE_2TM_{17}$ Permanent Magnets", IEEE Transactions on Magnetics, vol. MAG-20, No. 5, Sep. 1984, pp. 1593-1595.

Givord et al., "Crystal Chemistry and Magnetic Properties of the $R_2Fe_{14}B$ Family of Compounds", Oct. 25, 1984, pp. 131-142.

Lee, "Hot-Pressed Neodymium-Iron-Boron Magnets", Appl. Phys. Lett., vol. 46, Apr. 15, 1985, pp. 790-791.

Burzo, "Some New Results in the Field of Magnetism of Rare Earth Compounds", Acta Physica Polonica, Mar. 1985, pp. 1-17 w/drawings.

Ormerod, "Processing and Physical Metallurgy of NdFeB and Other Rare Earth Magnets", pp. 69-92.

Handbook on the Physics and Chemistry of Rare Earths, vol. 2, Chapter 15, pp. 231-241.

OTHER PUBLICATIONS

Greedan et al., "An Analysis of the Rare Earth Contribution to the Magnetic Anistropy in $RCo_5$ and $R_2Co_{17}$ Compounds", Journal of Solid State Chemistry, vol. 6, 1973, pp. 387–395.

Ray et al., "Easy Directions of Magnetization in Ternary $R_2(Co,Fe)_{17}$ Phases", IEEE Transactions on Magnetics, Sep. 1972, pp. 516–518.

Lee, "The Future of Rare Earth–Transition Metal Magnets of Type $RE_2TM_{17}$", J. Appl. Phys., vol. 52, Mar., 1981, pp. 2549–2553.

Ohashi et al., "Effects of Prasedymium Substitution on Precipitation Hardened Rare Earth Magnets", pp. 493–501.

Handbook on the Physics and Chemistry of Rare Earths, vol. 2, Chapter 14, pp. 55–56, 155–161.

Neumann et al., "Line Start Motors Designed With Nd–Fe–B Permanent Magnets", pp. 77–89.

PROCESS FOR PRODUCING MAGNETIC MATERIALS

FIELD OF THE INVENTION AND BACKGROUND

The present invention relates to novel rare earth magnets, and more particularly to high-performance permanent magnet materials based on FeBR systems which do not necessarily contain relatively scarce rare earth metals such as Sm, and are mainly composed of Fe and relatively abundant light rare earth elements, particularly Nd and Pr, which may find less use, and a process for the preparation of the same.

Permanent magnet materials are one of the important electric and electronic materials used in extensive areas ranging from various electrical appliances for domestic use to peripheral terminal devices for large-scaled computers. There has recently been an increasing demand for further upgrading of the permanent magnet materials in association with needs for miniaturization and high efficiency of electrical equipment. Magnet materials having high coercive forces have also been required in many practical fields such as, for instance, those for motors, generators and magnetic couplings.

Typical of the permanent magnets currently in use are alnico, hard ferrite and rare earth/cobalt magnets. Among these, the rare earth/cobalt magnets have taken the place of permanent magnets capable of meeting high magnet properties now required. However, the rare earth/cobalt magnets are very expensive due to the requirement of relatively scarce Sm and the uncertain supply of Co which is used in larger amounts.

To make is possible to use extensively the rare earth magnets in wider ranges, it is desired to mainly use light rare earth metals contained abundantly in ores as the rare earth elements and to avoid the use of much Co that is expensive.

In an effort to obtain such permanent magnet materials, R-$Fe_2$ base compounds, wherein R is at least one of the rare earth metals, have been investigated. A. E. Clark has discovered that sputtered amorphous $TbFe_2$ has an energy product of 29.5 MGOe at 4.2 degrees K., and shows a coercive force Hc=3.4 kOe and a maximum energy product (BH)max=7 MGOe at room temperature upon heat-treated at 300–500 degrees C. Reportedly, similar investigation on $SmFe_2$ indicated that 9.2 MGOe was reached at 77 degrees K. However, these materials are all obtained by sputtering in the form of thin films that cannot be generally used as magnets for, e.g., speakers or motors. It has further been reported that melt-quenched ribbons of PrFe base alloys show a coercive force Hc of as high as 2.8 kOe.

In addition, Koon et al discovered that, with melt-quenched amorphous ribbons of $(Fe_{0.82}B_{0.18})_{0.9}Tb_{0.05}La_{0.05}$, Hc of 9 kOe was reached upon annealing at 627 degrees C. (Br=5 kG). However, (BH)max is then low due to the unsatisfactory loop squareness of the magnetization curves (N. C. Koon et al, Appl. Phys. Lett. 39 (10), 1981, pp.840–842).

Moreover, L. Kabocoff et al reported that among melt-quenched ribbons of $(Fe_{0.8}B_{0.2})_{1-x}Pr_x$ (x=0–0.03 atomic ratio) certain ones of the Fe-Pr binary system show Hc on the kilo oersted order at room temperature.

These melt-quenched ribbons or sputtered thin films are not practical permanent magnets (bodies) that can be used as such. It would be practically impossible to obtain practical permanent magnets from these ribbons or thin films.

That is to say, no bulk permanent magnet bodies of any desired shape and size are obtainable from the conventional Fe-B-R base melt-quenched ribbons or R-Fe base sputtered thin films. Due to the unsatisfactory loop squareness (or rectangularity) of the magnetization curves, the Fe-B-R base ribbons heretofore reported are not taken as practical permanent magnet materials comparable with the conventional, ordinary magnets. Since both the sputtered thin films and the melt-quenched ribbons are magnetically isotropic by nature, it is indeed almost impossible to obtain therefrom magnetically anisotropic (hereinbelow referred to "anisotropic") permanent magnets for the practical purpose.

SUMMARY OF THE INVENTION

An essential object of the present invention is to obtain novel permanent magnet materials substantially free from the drawbacks of the prior art, for which relatively scarce rare earth elements such as Sm are not necessarily used, and which may not contain a great deal of components which may pose problems of resources.

Another object of the present invention is to provide a process for the preparation of permanent magnet materials having satisfactory magnet properties at room temperature or elevated temperatures and showing improved loop rectangularity of their magnetization curves.

A further object of the present invention is to obtain permanent magnet materials in which relatively abundant light rare earth elements can effectively be used, and a process for the preparation of same.

A still further object of the present invention is to provide a process for the preparation of permanent magnet materials which can be formed into any desired shape and practical size.

A still further object of the present invention is to provide a process for the preparation of novel permanent magnets free from Co.

Other objects of the present invention wll become apparent from the entire disclosure given hereinafter.

To attain the aforesaid objects, intensive studies were made of improvements in the magnetic properties of permanent magnets comprising alloys based on FeBR systems. It has been found that their magnetic properties upon sintering, especially coercive force and loop rectangularity or squareness of demagnetization curves, can be improved considerably by forming and sintering alloy powders having a specific particle size and, thereafter, subjecting the sintered bodies or masses to specific heat treatment or a so-called aging treatment.

More specifically, according to the present invention, the permanent magnet materials based on FeBR systems are prepared through a succession of steps of compacting alloy powders comprising, by atomic percent, 8 to 30% R representing at least one of rare earth elements inclusive of Y, 2 to 28% B and the balance being Fe with inevitable impurities and having a mean particle size of 0.3 to 80 microns, sintering the compacted bodies at 900 to 1200 degrees C. and, thereafter, subjecting the sintered bodies to heat treatment at a temperature lying between the sintering temperature and 350 degrees C.

In the following discussions, % will mean atomic % (at %) unless otherwise specified.

The alloys based on FeBR systems may include those based on FeCoBR systems in which the Fe of the FeBR systems is partly substituted with Co, FeBRM systems in which specific element(s) M is (are) added to the FeBR systems, and FeCoBRM systems in which the Fe of the FeBR systems is partly substituted with Co and specific element(s) M is (are) added further.

From other alloys based on the FeBR systems, viz., those based on the FeCoBR, FeBRM and FeCoBRM systems, the permanent magnet materials of the present invention can be prepared essentially in the same manner as used with the FeBR base alloys.

In the permanent magnets comprising the alloys based on the FeCoBR systems, a part of the Fe of the compositions based on the FeBR systems is substituted with 0 (exclusive) to 50 (inclusive) % Co.

In the permanent magnets comprising the alloys based on the FeBRM systems, the compositions based on the FeBR systems are added with one or more of the following elements M in the amounts or less as specified below, provided however that, when two or more elements M are added, the combined amount of M should be no more than the highest upper limit of those the elements actually added, with the exception that M is not zero. 4.5% Ti, 8.0% Ni, 5.0% Bi, 9.5% V, 12.5% Nb, 10.5% Ta, 8.5% Cr, 9.5% Mo, 9.5% W, 8.0% Mn, 9.5% Al, 2.5% Sb, 7.0% Ge, 3.5% Sn, 5.5% Zr and 5.5% Hf.

In the case of the permanent magnets comprising the alloys based on the FeCoBRM systems, said Co and said element(s) M are added to the compositions based on the FeBR systems. More specifically, a part of the Fe of the compositions based on said FeBRM systems is substituted with 0 (exclusive) to 50 (inclusive) % Co.

According to the present invention, magnetically anisotropic (hereinafter simply referred to as anisotropic) permanent magnets are prepared by carrying out forming in a magnetic field, but isotropic permanent magnets may be prepared alike by carrying out forming in the absence of magnetic fields maintaining the effect of an aging treatment.

When preparing the isotropic permanent magnets, useful magnetic properties are obtained if the FeBr base systems comprise 10 to 25% R, 3 to 23% B and the balance being Fe with impurities.

As is the case with the anisotropic permanent magnets, the isotropic permanent magnets may contain Co, and the element(s) M may be added thereto as well, although some of M are added in varied amounts. Thus, the following elements may be added, alone or in combination, in the amounts of less (at %) as specified below, provided that, when two or more M are added, the combined amount M should be no more than the highest upper limit of those of the elements actually added. 9.5% Al, 4.7% Ti, 10.5% V, 8.5% Cr, 8.0% Mn, 5.5% Zr, 5.5% Hf, 12.5% Nb, 10.5% Ta, 8.7% Mo, 6.0% Ge, 2.5% Sb, 3.5% Sn, 5.0% Bi, 4.7% Ni, and 8.8% W.

The Curie points and temperature dependence of the permanent magnets can be improved by substituting a part of the Fe of the FeBR systems with Co.

The addition of the element(s) M to the permanent magnet materials has an effect upon increases in the coercive force thereof.

DETAILED DESCRIPTION OF THE PREFERRED EMBODIMENTS

Figure 1:
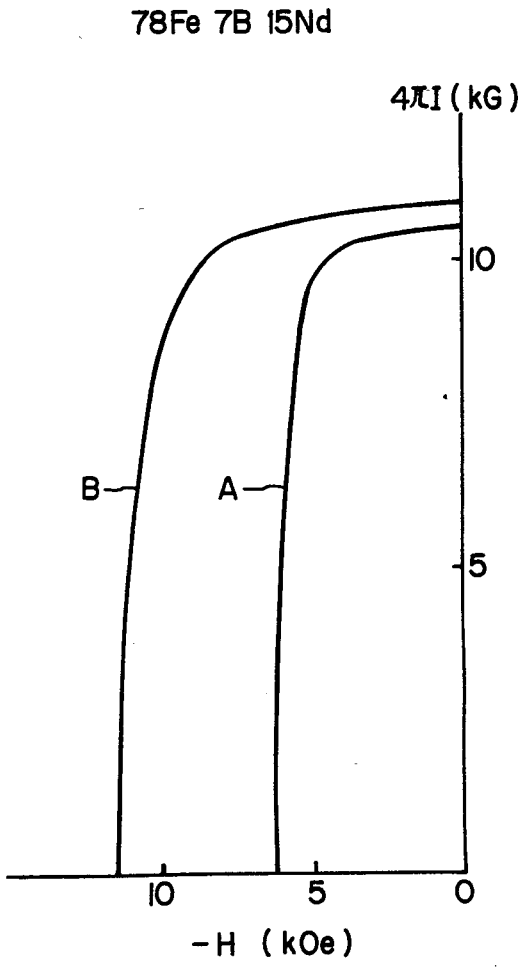
FIG. 1 is a graph showing the demagnetization curves of the magnets 78Fe-7B-15Nd, wherein A refers to a curve of the as-sintered magnets, and B to a curve of the magnet upon aging.

The present invention will now be explained in further detail.

In the permanent magnet materials of the present invention, Boron (B) shall be used on the one hand in an amount no less than 2% so as to meet a coercive force of 1 kOe or higher and, on the other hand, in an amount of not higher than 28% so as to exceed the residual magnetic flux density Br of about 4 kG of hard ferrite. R shall be used on the one hand in an amount no less than 8% so as to obtain a coercive force of 1 kOe or higher and, on the other hand, in an amount of 30% or less since it is easy to burn, incurs difficulties in handling and preparation, and is expensive.

The present invention offers an advantage in that less expensive light-rare earth elements occurring abundantly in nature can be used as R since Sm is not necessarily requisite nor necessarily requisite as a main component.

The rare earth elements R used according to the present invention include light- and heavy-rare earth elements inclusive of Y, and may be applied alone or in combination. Namely, R includes Nd, Pr, La, Ce, Tb, Dy, Ho, Er, Eu, Sm, Gd, Pm, Tm, Yb, Lu and Y. Usually, the use of light rare earth elements, will suffice, but particular preference is given to Nd and Pr. Practically, mixtures of two or more rare earth elements such as mischmetal, didymium, etc. may also be used due to their ease in availability. Sm, Y, La, Ce, Gd and the like may be used in combination with other rare earth elements such as Nd, Pr, etc. These rare earth elements R are not always pure rare earth elements and, hence, may contain impurities which are inevitably entrained in the production process, as long as they are technically available.

Boron represented by B may be pure boron or ferroboron, and those containing as impurities Al, Si, C etc. may be used.

As the component R, alloys of R with other constitutional elements such as R-Fe alloys, for example, Nd-Fe alloys and Pr-Fe alloys may be used.

In addition to B and R, the permanent magnets of the present invention contain Fe as the balance, but may contain impurities inevitably entrained in the course of production.

When comprising 8 to 30% R, 2 to 28% B and the balance being Fe, the permanent magnet materials of the present invention have magnetic properties as represented in terms of a maximum energy product, (BH)max, of 4 MGOe of hard ferrite or higher.

A preferable compositional range is 11 to 24% R in which light rare earth elements amount to 50% or higher of the overall R, 3 to 27% B and the balance being Fe, since (BH)max of 7 MGOe or higher is obtained. An extremely preferable compositional range is 12 to 20% R in which light rare earth elements amount to 50% or higher of the overall R, 4 to 24% B and the balance being Fe, since (BH)max of 10 MGOe to as high as 33 MGOe is reached.

The permanent magnets of the present invention are obtained by pulverizing, forming i.e. compacting, sintering and heat-treating the alloys of the aforesaid compositions.

The preparation process of the present invention will now be explained with reference to the preparation test of the anisotropic permanent magnets (FeBR systems).

The starting Fe was electrolytic iron having a purity of 99.0% or higher, the starting B was pure boron having a purity of 99.9% or higher or ferroboron having a purity of 90.0% or higher, and the starting R has a purity of 95% or higher. These materials were formulated within the aforesaid compositional range, and alloyed by high-frequency or arc melting in vacuo or an inert gas atmosphere, followed by cooling.

The thus obtained alloys were crushed in a stamp mill or jaw crusher, and finely pulverized in a jet mill, a ball mill or the like. Fine pulverization may be effected in the dry type manner wherein an inert gas atmosphere is applied, or in the wet type manner wherein an organic solvent such as acetone or toluene is used. The FeBR base alloy powders may have their composition modified or adjusted by constitutional elements or alloys thereof. This pulverization is continued until alloy powders having a mean particle size of 0.3 to 80 microns are obtained. Alloy powders having a mean particle size of below 0.3 micron undergo rapid oxidation during fine pulverization or in later steps, so that there is no appreciable increase in density, resulting in a lowering of the obtained magnet properties. On the other hand, a mean particle size exceeding 80 microns does not serve to provide magnets having excellent properties, among others, high coercive force. To attain excellent magnet properties, the mean particle size of fine powders is in a range of preferably 1 to 40 microns, more particularly 2 to 20 microns.

Powders having a mean particle size of 0.3 to 80 microns are formed under pressure in a magnetic field of, e.g., 5 kOe or higher. A preferable pressure for compacting is in a range of 0.5 to 3.0 ton/cm$^2$. The powders may be either formed under pressure as such in a magnetic field, or formed under pressure in a magnetic field in the presence of an organic solvent such as acetone or toluene. The thus obtained formed bodies are sintered at a temperture of 900 to 1200 degrees C. for a given period of time in a reducing or non-oxidizing atmosphere, for instance, in vacuo of $10^{-2}$ Torr or below, or in an inert or reducing gas atmosphere having a purity of 99.9% or higher under a pressure of 1 to 760 Torr.

When the sintering temperature is below 900 degrees C., it is impossible to obtain sufficient sintering density and high residual magnetic flux density. A sintering temperature exceeding 1200 degrees C. is not preferred, since the sintered bodies deform and the crystal grains mis-align, thus giving rise to decreases in both the residual magnetic flux density and the loop rectangularity of demagnetization curves.

For sintering, various conditions in respect of temperature, time, etc. are regulated to achieve the desired crystal grain size. For a better understanding of sintering, refer to the disclosure of a U.S. patent application Ser. No. 532,517 entitled "Process for Producing Permanent Magnet Materials", which is filed on the same date as the present application and to be assigned to the same assignee.

In view of magnetic properties, the density (ratio) of the sintered body is preferably 95% or higher of the theoretical density. For instance, a sintering temperature of 1060 to 1160 degrees C. yields a density of 7.2 g/cm$^3$ or more, which corresponds to 96% or more of the theoretical density.

Furthermore, sintering at 1100 to 1160 degrees C. gives a density of 99% or more of the theoretical density (ratio).

In the foregoing sintering example, a sintering temperature of 1160 degrees C., causes a drop of (BH)max, although the density increases. This appears to be due to a lowering of the iHc to rectangularity ratio, which is attributable to coarser crystal grains.

As disclosed in U.S. patent application Ser. No. 510,234 filed on July 1, 1983, the FeBR base compound magnets show crystalline X-ray diffraction patterns quite different from those of the conventional amorphous thin films and melt-quenched ribbons, and contain as the major phase a novel crystal structure of the tetragonal system. This is also true of the FeCoBr, FeBRM and FeCoBRM systems to be described later.

Typically, the magnetic materials of the present invention may be prepared by the process constituting the previous stage of the forming and sintering process for the preparation of the permanent magnets of the present invention. For example, various elemental metals are melted and cooled under such conditions that will yield substantially crystalline state (not amorphous state), e.g., cast into alloys having a tetragonal system crystal structure, which are then finely ground into fine powders.

As the magnetic material, use may be made of the powdery rare earth oxide $R_2O_3$ (a raw material for R). This may be heated with, e.g., powdery Fe, (optionally powdery Co), Powdery FeB and a reducing agent (Ca, etc) for direct reduction. The resultant powder alloys show a tetragonal system as well.

A sintering period of 5 minutes or longer gives good results, but too long a period poses a problem in connection to mass productivity. Thus, a preferable sintering period ranges from 0.5 to 8 hours. It is preferred that a sintering atmosphere such as a non-oxidizing or vacuum atmosphere, or an inert or reducing gas atmosphere is maintained at a high level, since the component R is very susceptible to oxidation at elevated temperature. To obtain high sintering density, sintering may advantageously be effected in a reduced pressure atmosphere up to 760 Torr wherein an inert gas is used.

No specific limitations are imposed upon a heating rate during sintering. However, it is preferred that, when wet forming is used, a heating rate of 40 degrees C./min or less, more preferably 30 degrees C./min or less, is applied for removal of solvent. It is also preferred that a temperature ranging from 200 to 800 degrees C. is maintained for one half hour, more preferably one hour or longer if binder is used, in the course of heating. When cooling is used after sintering, the cooling rate is preferably 20 degrees C./min or higher, more preferably 30 degrees C./min or higher, since there is then a lesser variation in the quality of products. It is preferred that a cooling rate of 100 degrees C./min or higher, more particularly 150 degrees C./min or higher down to a temperature of 800 degrees C. or less, is applied to improve further the properties of magnets by subsequent aging. However, aging may be carried out just after sintering has gone to completion.

The sintered bodies may be subjected to aging at a temperature between 350 degrees C. and the sintering temperature of the formed bodies for a period of 5 minutes to 40 hours in non-oxidizing atmosphere, e.g., vacuum, or in an atmosphere of inert or reducing gases. Since R in the alloying components reacts rapidly with oxygen and moisture at elevated temperatures, the atmosphere for aging should preferably be a degree of vacuum of $10^{-3}$ Torr or below and a purity of 99.99% or higher for the atmosphere of inert or reducing gases. Sintering temperature is selected from the aforesaid range depending upon the composition of the permanent magnet materials, while aging temperature is selected from between 350 degrees C. and the sintering temperature. For instance, the upper limits of aging temperature for 60Fe-20B-20Nd and 85Fe-5B-10Nd alloys are 950 degrees C. and 1050 degrees C., respectively. In general, higher upper limits are imposed upon the aging temperature of Fe-rich, B-poor or R-poor alloy compositions. However, too high an aging temperature causes excessive growth of the crystal grains of the magnet bodies according to the present invention, resulting in a lowering of the magnet properties, especially the coercive force thereof. In addition, there is a fear that the optimum aging period may become so short that difficulty is involved in control of production conditions. It is preferred that the mean crystal grain size of the sintered body stands in a range of 1 to 80 microns to permit the iHc of the FeBR systems to be equal to, or greater than, 1 kOe. The details of crystal grain size are disclosed in prior applications assigned to the same assignee as the present application (U.S. Ser. No. 510,234 filed on July 1, 1983; U.S. Ser. No. 516,841 filed on July 25, 1983), the disclosures of which are incorporated herein. An aging temperature of below 350 degrees C. requires a long aging period, and makes no contribution to sufficient improvements in the loop rectangularity of demagnetization curves. To prevent excessive growth of the crystal grains of the magnet bodies of the present invention and allow them to exhibit excellent magnet properties, the aging temperature is preferably in a range of 450 to 800 degrees C. (most preferably 500 to 700 degrees C.). Preferably, the aging period is in a range of 5 minutes to 40 hours. Although associated with the aging temperature, an aging period of below 5 minutes produces less aging effect, and gives rise to large fluctuations of the magnet properties of the obtained magnet bodies, while an aging period exceeding 40 hours is industrially impractical. In view of the exhibition of preferable magnet properties and the practical purpose an aging period of 30 minutes to 8 hours is preferable.

Aging may advantageously be effected in two-or multi-stages, and such multi-stage aging may of course be applied to the present invention. For instance, it is possible to obtain a magnet body having excellent magnet properties such as very high residual magnetic flux density, coercive force and loop rectangularity of its demagnetization curves by sintering an alloy of 80Fe-7B-13Nd composition at 1060 degrees C. followed by cooling and, thereafter, treating the sintered alloy at a temperature of 800 to 900 degrees C. for 30 minutes to 6 hours in the first aging stage and at a temperature of 400 to 750 degrees C. for 2 to 30 hours in the second and further stages. In the multi-stage aging treatment, marked improvements in coercive force are obtained by the second and further aging treatments.

Alternatively, aging may be effected by cooling the sintered bodies from 900 to 350 degrees (at least from 800 to 400 degrees C.) at a cooling rate of 0.2 to 20 degrees C./min, in the course of cooling resulting in the formation of magnet bodies having similar magnet properties. FIG. 1 shows the demagnetization curves of the anisotropic magnet body of 78Fe-7B-15 Nd composition, wherein curve A refers to that sintered at 1140 degrees C. for 2 hours, and curve B to that cooled down to room temperature and aged at 700 degrees C. for further two hours. Both curves A and B show good loop rectangularity; however, curve B (aging treatment) is much superior to A. This indicates that aging treatment is effective for further improvements in magnet properties.

Aging treatment including these treating procedures may be carried out successively upon sintering, or at re-elevated temperatures after cooling down to room temperature.

The present invention is not limited to the preparation of the anisotropic permanent magnets, and can be applied alike to the preparation of the isotropic permanent magnets, provided however that the forming step is performed in the absence of magnetic field. The obtained isotropic magnets can exhibit satisfactory properties. It is noted that, when comprising 10 to 25% R, 3 to 23% B, and the balance being Fe with impurities, the isotropic magnets according to the present invention show (BH)max of 2 MGOe or higher (50% or less Co may be present). The magnetic properties of isotropic magnets are originally lower than those of anisotropic magnets by a factor of $\frac{1}{4}$ to 1/6. Nonetheless, the isotropic magnets according to the present invention show very useful, high properties. As the amount of R increases, iHc increases, but Br decreases upon showing a peak. Thus the amount of R to satisfy (BH)max of 2 MGOe or higher should be in a range of 10 to 25% inclusive.

As the amount of B increases, iHc increases, but Br decreases upon showing a peak. Thus the amount of B should be in a range of 3 to 23% inclusive to attain (BH)max of 2 MGOe or higher.

A preferable compositional range is 12 to 20% R in which light rare earth elements amount to 50% or more of the overall R, 5 to 18% B and the balance being Fe, since high magnetic properties as represented by (BH)max of 4 MGOe or higher are attained. The most preferable range is 12 to 16% R for which light rare earth elements such as Nd or Pr are mainly used, 6 to 18% B and the balance being Fe, since it is feasible to achieve high properties as represented by (BH)max of 7 MGOe or higher, which could not been attained with the existing isotropic permanent magnets.

Binders and lubricants are not usually employed for the anisotropic magnets, since they impede the alignment of particles during compacting. However, they can be used for the isotropic magnets, since they serve to improve pressing efficiency and increase the strength of the formed bodies.

Returning to the anisotropic system, the permanent magnet materials based on the FeBR system permit the presence of impurities inevitably entrained in the course of production, and this holds for those based on FeCoBR, FeBRM and FeCoBRM systems. In addition to R, B and Fe, the permanent magnet materials may contain C, P, S, Cu, Ca, Mg, O, Si, etc., which contribute to the convenience of production and cost reductions. C may be derived from organic binders, and S, P, Cu, Ca, Mg, O, Si and so on may originally be present in the starting materials, or come from the process of production. The upper limits of C, P, S, Cu, Ca, Mg, O and Si are respectively 4.0%, 3.5%, 2.5%, 3.5%, 4.0%, 4.0%, 2.0% and 5.0%, provided however that the combined amount of them should be no more than 5% for practical purposes. The same holds for the cases containing Co and element(s) M. Similar discussion also holds for the isotropic magnets, except that the upper limits of P and Cu are both 3.3%.

Preferably, the allowable limits of typical impurities to be included in the end products should be no higher than the following values by atomic percent:

2% Cu, 2% C, 2% P, 4% Ca, 4% Mg, 2% O, 5% Si, and 2% S, provided that the sum of impurities should be no more than 5% to obtain (BH)max of 20 MGOe or higher (Br 9 kG or higher).

As stated above, the present invention can provide as the first embodiment the permanent magnet materials based on FeBR systems but free from Co, which are inexpensive and excel in residual magnetic flux density, coercive force and energy product, and offer a technical and industrial breakthrough.

The starting alloy powders to be used may include alloy powders formulated in advance to the predetermined composition, FeBR base alloys formulated to the predetermined composition by the addition of auxiliary constitutional elements or alloys thereof etc.

Cooling of the FeBR base alloys is made at least under such conditions that yield substantially the crystalline state, and ingots, castings, or alloys obtained from $R_2O_3$ by direct reduction meet this requirement.

The second embodiment of the present invention relates to permanent magnet materials based FeCoBR systems. The Curie point and temperature dependence of the magnet materials can be increased and improved by substituting with Co a part of the main component, Fe, of the FeBR base magnets. In addition, the alloys of constant composition are formed in the powdery form, sintered, and subjected to heat treatment under specific conditions or aging treatment, thereby to improve the magnet properties of the resulting magnets, especially the coercive force and loop rectangularity of demagnetization curves, as is substantially the case with the first embodiment (FeBR).

According to the second embodiment, the permanent magnet materials based on FeCoBR systems are provided by forming the powders of alloys having a mean particle size of 0.3 to 80 microns and comprising 8 to 30% R (at least one of rare earth elements including Y), 0 (exclusive) to 50 (inclusive) % Co, 2 to 28% B and the balance being Fe with inevitable impurities, sintering the formed bodies and heat-treating the sintered bodies.

The forming, sintering and heat treatment (aging) in the second embodiment are essentially identical with those in the FeBR base embodiment, except the points discussed later.

It is noted that the FeCoBR base alloys may be formulated from the outset in the form of containing Co, or may be prepared according to the predetermined composition by adding to the FeBR base alloys Co alloys with constitutional elements serving as a complementary composition such as, for example, R-Co alloys.

In general, when Co is added to Fe alloys, the Curie points of some alloys increase proportionally with its amount, while those of another drop, so that difficulity is involved in the anticipation of the effect of Co addition.

Figure 2:
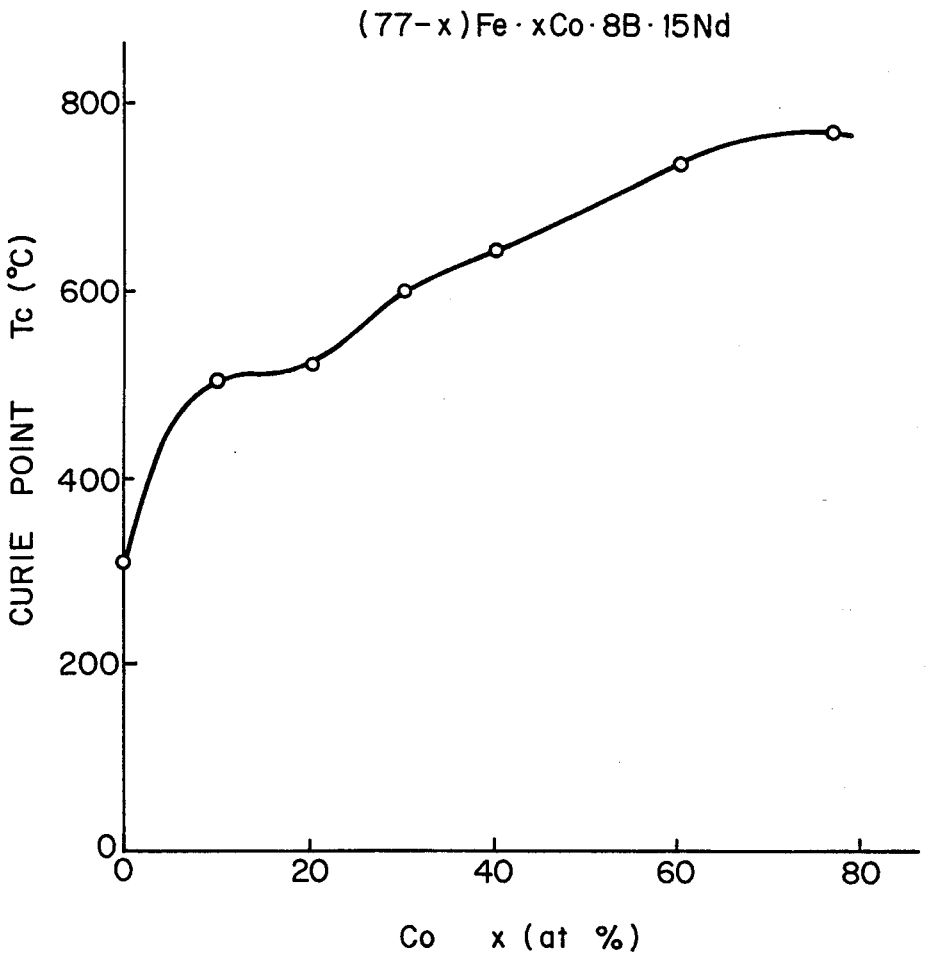
FIG. 2 is a graph showing the relationship between the amount of Co and the Curie point Tc (degrees C.) in the FeCoBR base alloys.

According to the present invention, it has been found that, when a part of Fe of the FeBR systems is substituted with Co, the Curie point increases gradually with increases in the amount of Co to be added, as illustrated in FIG. 2. Similar tendencies are invariably observed in the FeBR base alloys regardless of the type of R. Co is effective for increases in Curie point even in a slight amount of, e.g., 1%. As illustrated in FIG. 2, alloys having any Curie point between about 300 and about 750 degrees C. are obtained depending upon the amount of x in (77-x)Fe-xCo-8B-15Nd.

The amounts of the respective components B, R and (Fe+Co) in the FeCoBR base permanent magnets are basically identical with those in the FeBR base magnets.

The upper limit of Co to be substituted for Fe is 50%, partly because it is required to obtain iHc of 1 kOe or higher, and partly because it serves to improve Tc but is expensive.

A preferable compositional range for FeCoBR is 11 to 24% R in which light rare earth elements are used as the main component in amounts of 50% or higher, 3 to 27% B, 45% or less Co and the balance being substantially Fe, since (BH)max of 7 MGOe or more is achieved. An extremely preferable compositional range is 12 to 20% R in which light rare earth elements amount to 50% or more of the overall R, 4 to 24% B, 35% or less Co and the balance being substantially Fe, since excellent magnetic properties as represented by (BH)max of 10 MGOe to as high as 33 MGOe are obtained. The temperature dependence is also good, as will be understood from the fact that the temperature coefficient $\alpha$ of Br is 0.1%/degrees C. or below, when the amount of Co is 5% or higher. In an amount of 25% or below, Co contributes to an increase in Tc without having adverse influence upon other properties.

The FeCoBR base magnets according to this embodiment not only show better temperature dependence, compared with the Co-free FeBR base magnets, but also have their loop rectangularity of demagnetization curves improved by the addition of Co, thus leading to improvements in the maximum energy product. In addition, Co addition can afford corrosion resistance to the magnets, since Co is greater in corrosion resistance than Fe.

In the case of Co-containing products, the mean particle size of the starting alloy powders as well as forming and sintering are basically identical with those of the FeBR base embodiment, and the basic temperature range for aging treatment (350 degrees C. to the sintering temperature) is identical with that in the first embodiment, and suitable temperatures may be selected due to the presence of Co as mentioned below.

Referring to 50Fe-10Co-20B-20Nd and 65Fe-20Co-5B-10Nd alloys as examples, the upper limits of their aging treatment are 950 degrees C. and 1050 degrees C., respectively. As is the case with the FeBR base embodiment, the optimum aging temperature is in a range of 450 to 800 degrees C., and the treatment period in a range of 5 min to 40 hours.

Upon subjected to multi-stage aging treatment similar to that applied to the aforesaid 80Fe-7B-13Nd alloy, a good aging effect is obtained as well with, for instance, a 65Fe-15Co-7B-13Nd alloy.

Instead of such multi-stage aging treatment, the application of cooling from the temperature for aging treatment down to room temperature at a given cooling rate is also favorable.

An effect due to Co addition is also observed in the case of the isotropic products.

According to the third embodiment of the present invention, one or more elements M are added to the basic FeBR systems, and the elements M are grouped into M1 group and M2 group for the purpose of convenience. M1 group includes Ti, Zr, Hf, Mn, Ni, Ge, Sn, Bi and Sb, while M2 group includes V, Nb, Ta, Mo, W, Cr and Al. The addition of elements M serves to increase further coercive force and loop rectangularity of demagnetization curves through aging treatment.

To make clear the effect of the individual elements M upon Br, the changes in B were measured at varied amounts thereof. The lower limit of Br is fixed at about 4 kG of hard ferrite. In consideration of (BH)max of about 4 MGOe of hard ferrite or higher, the upper limits of the amounts of M to be added are fixed at:

for M1 group, 4.5% Ti, 5.5% Zr, 5.5% Hf, 8.0% Mn, 8.0% Ni, 7.0% Ge, 3.5% Sn, 5.0% Bi, and 2.5% Sb, and for M2 group, 9.5% V, 12.5% Nb, 10.5% Ta, 9.5% Mo, 9.5% W, 8.5% Cr, and 9.5% Al.

In the third embodiment of the present invention, one or more elements M are added. When two or more elements M are used, the obtained properties lie between those resulting from the individual elements, the amounts of the individual elements are within the aforesaid ranges, and the combined amount thereof should be no more than the highest upper limit of those of the elements actually added.

Within the aforesaid FeBRM compositional range, a maximum energy product, (BH)max, of 4 MGOe or higher of hard ferrite is obtained. (BH)max of 7 MGOe or higher is obtained with a compositional range comprising 11 to 24% R in which light rare earth elements amount to 50% or higher of the overall R, 3 to 27%, B, elements M1—up to 4.0% for Ti, up to 4.5% for Zr, up to 4.5% for Hf, up to 6.0% for Mn, up to 3.5% for Ni, up to 5.5% for Ge, up to 2.5% for Sn, up to 4.0% for Bi and up to 1.5% for Sb; elements M2—up to 8.0% for V, up to 10.5% for Nb, up to 9.5% for Ta, up to 7.5% for Mo, up to 7.5% for W, up to 6.5% for Cr and up to 7.5% for Al, wherein the combined amount of M should be no more than the highest upper limit of those of the elements actually added, and the balance being substantially Fe. Therefore, that compositional range is preferable. The most preferable compositional range based on FeBRM comprises 12 to 20% R in which light rare earth elements amount to 50% or higher of the overall R, 4 to 24% B, elements M1—up to 3.5% for Ti, up to 3.5% for Zr, up to 3.5% for Hf, up to 4.0% for Mn, up to 2.0% for Ni, up to 4.0% for Ge, up to 1.0% for Sn, up to 3.0% for Bi and up to 0.5% for Sb; elements M2—up to 6.5% for V, up to 8.5% for Nb, up to 8.5% for Ta, up to 5.5% for Mo, up to 5.5% for W, up to 4.5% for Cr and up to 5.5% for Al, wherein the combined amount of M should be no more than the highest upper limit of those of the elements actually added, and the balance being substantially Fe, since (BH)max of 10 MGOe or higher is sufficiently feasible, and (BH)max of 33 MGOe or higher is reached.

Preferable as the elements M is M2 group, because an effect due to aging treatment is easily obtained. Besides, a main difference between M1 and M2 consists in the selection of aging treatment conditions. Except the considerations as discussed, the same comments given on the FeBR base embodiment are maintained.

Referring to M2, cooling following sintering is carried out preferably at a cooling rate of 20 degrees C./min or higher, since there is then a lesser variation of the quality of products. For M1, a preferable cooling rate is 30 degrees C./min or higher. To improve the properties of magnets by subsequent heat treatment, i.e., aging, a cooling rate is preferably 100 degrees C./min or higher for M2 and 150 degrees C./min for M1.

For the typical upper temperatures of aging treatment allowed for the FeBR systems and other systems, refer to Table 1.

When M is added, an aging period is about 5 minutes to about 40 hours, as is the case with the FeBR systems.

Multi-stage aging treatment and alternative aging by cooling at given cooling rates in the course of cooling may be carried out in the manner as exemplified in Table 2, which also shows those applied to other systems.

It is noted that the mean particle size of the sintered bodies is preferably in a range of 1 to 90 microns for the FeBRM systems and 1 to 100 microns for both the FeCoBR and FeCoBRM systems. In all the systems including the basic FeBR systems, the mean particle size of the sintered bodies is preferably 2 to 40 microns, most preferably 3 to 10 microns. It is further preferred that such a mean particle size is maintained after aging.

The discussions given on the particle size of the starting alloy powders for the FeBR systems hold for other systems.

Even when the element(s) M is(are) contained, the isotropic magnets can be prepared in the same manner as applied to the FeBR systems, and this holds for the Co-containing systems, i.e., the FeCoBRM systems to be described later. In this case, the upper limits of M are preferably equal to those determined for the anisotropic systems with the following exceptions:

M1: 4.7% for Ti, 4.7% for Ni and 6.0% for Ge

M2: 10.5% for V and 8.8% for W

Regardless of the type of M, the Br of the isotropic systems tends to decrease, as the amount of M increases. However, as long as the amount of M is within the aforesaid range, Br of 3 kG or higher is obtained (to attain (BH)max equal to, or higher than 2 MGOe of isotropic hard ferrite).

Like the FeBR base magnets, the FeBRM, FeCoBR and FeCoBRM base magnets also permit the presence of impurities inevitably entrained in the course of industrial production.

According to the fourth embodiment of the present invention, the FeCoBRM base permanent magnets are prepared by substituting with Co a part of the Fe of the FeBRM systems.

The permanent magnets according to the fourth embodiment have their temperature dependence improved by the substitution of a part of the Fe of the FeBR base magnet materials with Co and their coercive force and loop rectangularity improved by the addition of M and the application of aging treatment.

An effect due to the inclusion of Co is similar to that in the second embodiment (FeCoBR systems), and an effect due to the inclusion of M is similar to that in the third embodiment (FeBRM systems). The FeCoBRM base magnets have such two effects in combination.

The method of the preparation of the FeCoBRM systems is basically identical with that of FeBR systems, but the sintering and aging temperatures are selected from the basic range depending upon composition. A typical basic range for such temperature is already stated in Table 1. For the ranges for multi-stage aging treatment, alternative aging by cooling, and cooling rates for said cooling, see also Table 2.

The effects and embodiments of the present invention will now be explained with reference to the examples; however, it is understood that the present invention is not limited to the examples and the manner of disclosure given hereinbefore and hereinafter.

The samples used in the examples were generally prepared through the following steps.

(1) As the starting iron and boron, electrolytic iron having a purity of 99.9% (by weight %—the purity will be expressed in terms of by weight % hereinafter) and a ferroboron alloy (19.38% B, 5.32% Al, 0.74% Si, 0.03% C and the balance being Fe) were used. The R used had a purity 99% or higher (impurities were mainly other rare earth metals). Electrolytic Co with a purity of 99.9% was used as Co. As M, use was made of Ti, Mo, Bi, Mn, Sb, Ni, Ta, Sn and Ge, each having a purity of 99%, W having a purity of 98%, Al having a purity of 99.9%, Hf having a purity of 95%, and ferrozirconium containing 75.5% zirconium.

(2) The raw material for magnets was melted by high-frequency induction. As the crucible, an alumina crucible was then used. The obtained melt was cast in a water-cooled copper mold to obtain an ingot.

(3) The thus obtained ingot was crushed to 25–50 mesh, and subsequently finely pulverized in a ball mill until powders having a given mean particle size were obtained.

(4) The powders were compacted under given pressures in a magnetic field. However, no magnetic filed was applied in the case of the production of isotropic magnets.

(5) The compacted body or mass was sintered at 800 to 1200 degrees C. in a given atmosphere and, thereafter, subjected to given heat treatment.

EXAMPLE 1

Parenthesized figures indicate the conditions to be used in Example 5.

An alloy of, by atomic percent, 78Fe-7B-15Nd (66Fe-14Co-6B-14Nd) composition was prepared by high-frequency melting in an Ar atmosphere and casting with a water-cooled copper mold. This alloy we crushed in a stamp mill to 40 (35) mesh or less, and finely pulverized in a ball mill in an Ar atmosphere to a mean particle size of 8 (5) microns or less. The obtained powders were formed at a pressure of 2.2 (2.0) ton/cm$^2$ in a 10 kOe magnetic field, sintered at 1140 (1120) degrees C. for two hours in a 760 Torr atmosphere of argon having a purity of 99.99%, and cooled down to room temperature at a cooling rate of 500 degrees C./min. Thereafter, an aging treatment was carried out at 700 (650) degrees C. for 10, 120, 240 resp. 3000 minutes to obtain the magnets according to the present invention, the magnet properties of which are shown in Table 3.

FIG. 1 also shows the demagnetization curves of 78Fe-7B-15Nd alloy wherein the demagnetization curves of the alloy upon sintering and aging (700 degrees C.$\times$120 min) are designated as A and B, respectively. From this figure, it is evident that the aging treatment produces a marked effect.

EXAMPLE 2

Parenthesized figures indicate the conditions to be used in Example 6

An alloy of, by atomic percent, 70Fe-15B-7Nd-8Pr (54Fe-13Co-15B-16Nd-2Y) composition was prepared by Ar gas arc melting and casting with a water-cooled copper mold. This alloy was crushed in a stamp mill to 40 (50) mesh or below, and finely pulverized to a mean particle size of 3 microns in an organic solvent. The thus obtained powders were formed at a pressure of 1.5 ton/cm$^2$ in a 15 kOe magnetic field, sintered at 1170 (1175) degrees C. for one (four) hours in 250 Torr Ar having a purity of 99.999%, and cooled down to room temperature at a cooling rate of 200 degrees C./min. Thereafter, aging treatment was carried out in vacuo of $2\times10^{-5}$ Torr at the temperatures as specified in Table 4 for 2 hours to obtain the magnets of the present invention, whose properties are shown in Table 4 together with the results of a reference test.

EXAMPLE 3

Parenthesized figures indicate the conditions to be used in Example 7

FeBr (FeCoBR) alloys having the compositions as specified in Table 5 were prepared by Ar gas arc melting and casting with a water cooled copper mold. These alloys were crushed, pulverized, formed, sintered and aged to obtain the magnets of the present invention under substantially similar conditions as shown in Example 4 subject to compacting in the magnetic field and slight modifications on the other points. The resultant properties are shown in Table 5 together with those of a reference test in which the magnet was in an as-sintered condition.

EXAMPLE 4

Parenthesized figures indicate the conditions to be used in Example 8

FeBR (FeCoBR) alloys having the compositions as specified in Table 6 were prepared by Ar gas arc melting and casting with a water-cooled copper mold. These alloys were crushed in a stamp mill to 35 (25) mesh or below, and finely pulverized to a mean particle size of 7 (4) microns in an organic solvent. The obtained powders were formed at a pressure of 1.2 (1.5) ton/cm$^2$ in the absence of magnetic field, sintered at 1080 (1025) degrees C. in 210 (380) Torr Ar having a purity of 99.999% for 1 (2) hours, and rapidly cooled down to room temperature at a cooling rate of 300 (200) degrees C./min. Thereafter, aging treatment was carried out at 650 (700) degrees C. in 650 Torr Ar for 3 (4) hours to obtain the magnets of the present invention. The properties of the magnets are shown in Table 6 together with those of reference tests in which no aging was applied.

EXAMPLE 5

Figure 3:
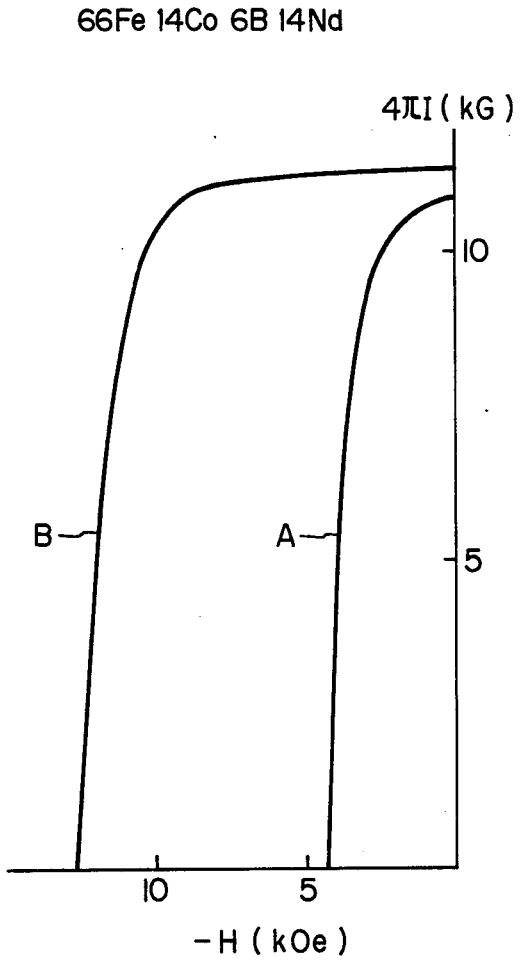
FIG. 3 is a graph showing the demagnetization curve of one example of the present invention (66Fe-14Co-6B-14Nd).

In accordance with the conditions given by the parenthesized figures in Example 1, an alloy of 66Fe-14Co-6B-14Nd composition was prepared, pulverized, formed, sintered and aged to obtain the magnets. The properties and temperature coefficient $\alpha$ (%/degree C.) of residual magnetic flux density (Br) of the magents are shown in Table 7 together with those of a reference test in which the magnet was in an as-sintered condition. FIG. 3 also shows the demagnetization curves of 66-Fe-14Co-6B-14Nd alloy wherein the as-sintered alloy and the alloy upon aging (650 degrees C.$\times$120 min) are designated as A and B, respectively.

EXAMPLE 6

In accordance with the conditions given by the parenthesized figures in Example 2, an alloy of, by atomic percent, 54Fe-13Co-15B-14Nd-2Y was prepared, pulverized, formed, sintered and aged to obtain the magnets. The properties and temperature coefficient $\alpha$ (%/degree C.) of residual magnetic flux density (Br) of the magnets are shown in Table 8 together with those of a reference test in which the magnet was in an as-sintered condition.

EXAMPLE 7

In accordance with the slightly modified conditions from Example 3, alloys of the compositions as given by atomic percent in Table 9 were prepared, pulverized, formed, sintered and aged to obtain the magnets of the present invention, the properties and temperature coefficient $\alpha$ (%/degree C.) of residual magnetic flux density (Br) of the magnets are shown in Table 9 together with those of a reference test in which the magnet was in an as-sintered condition.

EXAMPLE 8

In accordance with the conditions given by the parenthesized figures in Example 4, alloys of the compositions as specified in Table 10 were prepared, pulverized, formed, sintered and aged to obtain the magnets of the present invention. The properties are shown in Table 10 together with those of a reference test in which the magnet was in an as-sintered condition.

EXAMPLE 9

FeBRM base alloy powders of the compositions and mean particle size as given in Table 11 were formed under pressure under given conditions, sintered at given temperatures in an Ar atmosphere of given pressures with the purity being 99.99% for 2 hours, and cooled down to room temperature at given cooling rates. Thereafter, aging treatment was carried out at given temperatures in an atmosphere for 40, 120, 240 resp. 3000 minutes to obtain the magnets materials. The magnet properties of the materials are shown in Table 11.

EXAMPLE 10

FeBRM2 base alloy powders having given particle sizes were formed at given pressures in given magnetic fields, sintered at given temeperatures for given periods in an Ar atmosphere of given pressures with the purity being 99.999%, and cooled down to room temperature at given cooling rates. Thereafter, aging treatment was carried out in vacuo for 2 hours at temperatures as specified in Table 12 to obtain the permanent magnets. The properties of the magnets are shown in Table 12 together with those of reference test wherein the magnets were in an as-sintered condition.

EXAMPLE 11

FeBRM2 base alloy powders having the compositions as specified in Table 13 and given mean particle sizes were formed at given temperatures in a magnetic field, sintered at given pressures and pressures for given periods in an Ar atmosphere of given pressures with purity being 99.999%, and rapidly cooled down to room temperatures at given cooling rates. Thereafter, aging treatment was carried out at given temperature for given periods in an Ar atmosphere to obtain the permanent magnets. The properties of the magnets are shown in Table 13 together with those of reference tests (as-sintered magnets).

EXAMPLE 12

FeBRM2 base alloy powders having given mean particle sizes were formed at given pressures in the absence of magnetic fields, sintered at given temperatures for given periods in an Ar atmosphere having a purity of 99.999%, and rapidly cooled down to room temperature at given cooling rates. Thereafter, aging treatment was carried out at given temperatures for given periods in an Ar atmosphere to obtain isotropic permanent magnets. The properties of the magnets are shown in Table 6 together with those of the as-sintered samples not subjected to aging treatment

EXAMPLE 13

The magnets having the FeBRM1 base compositions as stated in Table 11 were obtained under the conditions as stated in Table 11 in accordance with the procedures of Example 9. The results are shown in Table 11.

EXAMPLE 14

The magnets having the FeBRM1 base compositions as stated in Table 12 were obtained under the conditions as stated in Table 12 in accordance with the manner of Example 10, except that aging treatment was performed in vacuo of $3\times10^{-5}$ Torr. The results are shown in Table 12.

EXAMPLE 15

The magnets having the FeBRM1 base compositions as stated in Table 13 were obtained under the conditions as stated in Table 13 in accordance with the procedures of Example 11. The results are shown in Table 13.

EXAMPLE 16

The magnets having the FeBRM1 base compositions as stated in Table 14 were obtained under the conditions as stated in Table 14 in accordance with the manner of Example 12, except that sintering was performed in an Ar atmosphere having a purity of 99.99%. The results are shown in Table 14.

EXAMPLE 17

The magnets having the FeCoBRM2 base compositions as stated in Table 15 were obtained under the conditions as stated in Table 15 in accordance with the procedures of Example 9. The results and the temperature coefficient $\alpha$ (%/degree C.) of Br are shown in Table 15 together with those of reference tests (as-sintered samples).

EXAMPLE 18

The magnets of the FeCoBRM2 base compositions as stated in Table 16 were obtained under the conditions as stated in Table 16 in accordance with the procedures of Example 10, except that aging was performed in vacuo of $2\times10^{-5}$ Torr. The results and the temperature coefficient $\alpha$ (%/degree C.) of Br are shown in Table 16 together with those of reference tests (as-sintered samples).

EXAMPLE 19

The magnets having the FeCoBRM2 base compositions as stated in Table 17 were obtained under the conditions as stated in Table 17 in the manner of Example 11, except that aging was performed in Ar of 600 Torr. The results and the temperature coefficient $\alpha$ (%/degree C.) of Br are shown in Table 17 together with those of reference tests (as-sintered samples).

EXAMPLE 20

The magnets having the FeCoBRM2 base compositions as stated in Table 18 were obtained under the conditions as stated in Table 18 in the manner of Example 12, except that the sintering atmosphere used was Ar having a purity of 99.9% and aging was performed in Ar of 650 Torr. The thus obtained magnets were isotropic, and the results are shown in Table 18 together with those of reference tests (samples not subjected to aging).

EXAMPLE 21

The magnets having the FeCoBRM1 base compositions as stated in Table 15 were obtained under the conditions as stated in Table 15 in accordance with the procedures of Example 17. The results are shown in Table 15.

EXAMPLE 22

The magnets having the FeCoBRM1 base compositions as stated in Table 16 were obtained uner the conditions as stated in Table 16 in the manner of Example 18, except that aging was performed in vacuo of $3\times10^{-5}$ Torr. The results are shown in Table 18.

EXAMPLE 23

The magnets having the FeCoBRM1 base compositions as stated in Table 17 were obtained under the conditions as stated in Table 17 in accordance with the procedures of Example 19. The results are shown in Table 17.

EXAMPLE 24

The magnets having the FeCoBRM1 base compositions as stated in Table 18 were obtained under the conditions as stated in Table 18 in accordance with the procedures of Example 20. The obtained magnets are isotropic, and the results are shown in Table 18.

EXAMPLE 25

An alloy of, by atomic percent, of 72Fe-9B-16Nd-2Ta-1Mn having a mean particle size of 2 microns was compacted in a magnetic field of 15 kOe under a pressure of 1.0 ton/cm$^2$. The resultant body was sintered at 1100 degrees C. in 650 Torr Ar of 99.99% purity for 2 hours, then cooled down to room temperature with a cooling rate 600 degrees C./min to obtain an as-sintered magnet. Aging was made on a sample at 700 degrees C. for 120 min. The results are shown below.

| | Br (kG) | iHc (kOe) | (BH) max (MGOe) |
|---|---|---|---|
| as-sintered | 12.4 | 8.5 | 31.9 |
| aged | 12.5 | 10.2 | 33.7 |

TABLE 1

| system | alloy composition at % | upper limit of the aging temperature °C. |
|---|---|---|
| Fe—B—R | 60Fe—20B—20Nd | 950 |
| | 85Fe—5B—10Nd | 1050 |
| Fe—Co—B—R | 50Fe—10Co—20B—20Nd | 950 |
| | 65Fe—20Co—5B—10Nd | 1050 |
| Fe—B—R—M2 | 69Fe—12B—17Nd—2W | 920 |
| | 80Fe—5B—13Nd—2Al | 1030 |
| Fe—B—R—M1 | 67Fe—13B—18Nd—2Hf | 930 |
| | 80Fe—4B—14Nd—2Sb | 1020 |
| Fe—Co—B—R—M2 | 68Fe—10Co—8B—12Nd—2Ti | 920 |
| | 58Fe—20Co—5B—16Nd—1Al | 1030 |
| Fe—Co—B—R—M1 | 71Fe—5Co—8B—14Nd—2Ti | 950 |
| | 52Fe—25Co—5B—17Nd—1Mn | 1000 |

TABLE 2

| alloy composition (system) at % | sintering temp. | multi-stage aging: 1st stage | multi-stage aging: 2nd and further stage | aging at cooling: cooling rate | aging at cooling: temp. range of aging |
|---|---|---|---|---|---|
| 80Fe—7B—13Nd (Fe—B—R) | 1060° C. | 800-900° C. 0.5-6 hrs | 400-750° C. 2-30 hrs. one or more | 0.2-20° C./min | 350-900° C. |
| 65Fe—15Co—7B—13Nd (Fe—Co—B—R) | 1060° C. | 800-900° C. 0.5-6 hrs | 400-750° C. 2-30 hrs. one or more | 0.2-20° C./min | 350-900° C. |
| 78Fe—7B—13Nd—1Mo—1Nb (Fe—B—R—M2) | 1050° C. | 820-920° C. 0.5-6 hrs | 400-750° C. 2-30 hrs. one or more | 0.2-20° C./min | 400-800° C. |
| 77Fe—7B—14Nd—1Ni—1Ge (Fe—B—R—M1) | 1040° C. | 800-900° C. 0.5-8 hrs | 400-700° C. 2-70 hrs. one or more | 0.2-20° C./min | 400-800° C. |
| 68Fe—10Co—7B—13Nd—1Mo—1Nb (Fe—Co—B—R—M2) | 1050° C. | 820-920° C. 0.5-6 hrs | 400-750° C. 2-30 hrs. one or more | 0.2-20° C./min | 400-800° C. |
| 68Fe—5Co—7B—18Nd—2Ge (Fe—Co—B—R—M1) | 1100° C. | 800-950° C. 0.5-8 hrs | 400-800° C. 2-70 hrs. one or more | 0.2-20° C./min | 350-950° C. |

TABLE 3

| aging temp. (°C.) | aging time (min) | Br (kG) | iHc (kOe) | (BH) max (MGOe) |
|---|---|---|---|---|
| reference test (as-sintered) | | 10.6 | 6.2 | 25.3 |
| 700 | 10 | 10.8 | 9.5 | 28.1 |
| 700 | 120 | 10.9 | 11.7 | 29.0 |
| 700 | 240 | 10.9 | 12.5 | 29.2 |
| 700 | 3000 | 10.9 | 11.9 | 28.5 |

TABLE 4

| aging temp. (°C.) | aging time (min) | Br (kG) | iHc (kOe) | (BH) max (MGOe) |
|---|---|---|---|---|
| 200 | 120 | 8.3 | 6.2 | 15.3 |
| 450 | 120 | 8.4 | 9.2 | 16.1 |
| 650 | 120 | 8.4 | 9.9 | 16.6 |
| 850 | 120 | 8.4 | 9.8 | 16.8 |
| 950 | 120 | 8.5 | 9.4 | 16.7 |
| reference test (as-sintered) | | 8.3 | 6.1 | 15.1 |

TABLE 5

| composition at % | Br (kG) | iHc (kOe) | (BH) max (MGOe) |
|---|---|---|---|
| 76Fe10B14Nd | 10.7 | 12.0 | 25.3 |
| 63Fe19B18Pr | 8.2 | 10.1 | 13.1 |
| 68Fe17B10Nd5Gd | 8.5 | 8.5 | 14.5 |
| 74Fe10B16Ho | 6.4 | 8.4 | 8.2 |
| 66Fe19B8Nd7Tb | 7.6 | 9.3 | 11.3 |
| 68Fe17B10Nd5Gd reference test (as-sintered) | 8.4 | 6.7 | 13.9 |
| 66Fe19B8Nd7Tb reference test (as-sintered) | 7.5 | 7.2 | 11.0 |

TABLE 6

| Composition at % | Br (kG) | iHc (kOe) | (BH) max (MGOe) |
|---|---|---|---|
| 75Fe10B15Nd | 5.3 | 10.5 | 5.8 |
| 78Fe8B14Nd | 5.5 | 11.2 | 5.9 |
| 78Fe8B12Nd2Gd | 5.5 | 10.2 | 5.5 |
| 75Fe10B15Nd reference test (as-sintered) | 5.2 | 6.5 | 5.2 |
| 78Fe8B14Nd reference test (as-sintered) | 5.3 | 7.2 | 5.1 |

TABLE 7

| aging temp. (°C.) | aging time (min) | Br (kG) | iHc (kOe) | (BH) max (MGOe) | α (%/°C.) |
|---|---|---|---|---|---|
| reference test | | 10.9 | 4.4 | 18.7 | 0.086 |

TABLE 7-continued

| aging temp. (°C.) | aging time (min) | Br (kG) | iHc (kOe) | (BH) max (MGOe) | α (%/°C.) |
|---|---|---|---|---|---|
| (as-sintered) | | | | | |
| 650 | 10 | 11.2 | 8.8 | 25.6 | 0.084 |
| 650 | 120 | 11.3 | 12.5 | 32.7 | 0.085 |
| 650 | 240 | 11.0 | 13.0 | 31.5 | 0.085 |
| 650 | 3000 | 10.7 | 11.5 | 17.9 | 0.085 |

TABLE 8

| aging temp. (°C.) | aging time (min) | Br (kG) | iHc (kOe) | (BH) max (MGOe) | α (%/°C.) |
|---|---|---|---|---|---|
| 200 | 120 | 10.8 | 6.5 | 16.9 | 0.082 |
| 450 | 120 | 11.2 | 8.3 | 25.3 | 0.081 |
| 650 | 120 | 11.2 | 10.7 | 32.7 | 0.082 |
| 850 | 120 | 11.3 | 11.6 | 28.9 | 0.081 |
| 950 | 120 | 11.2 | 10.2 | 26.3 | 0.081 |
| reference test (as-sintered) | | 10.8 | 6.3 | 19.9 | 0.081 |

TABLE 9

| composition at % | Br (kG) | iHc (kOe) | (BH) max (MGOe) | α (%/°C.) |
|---|---|---|---|---|
| 58Fe12B18Nd12Co | 12.2 | 7.3 | 34.2 | 0.08 |
| 53Fe8B14Pr25Co | 12.0 | 10.2 | 32.7 | 0.07 |
| 47Fe8B11Nd5Tb29Co | 11.7 | 9.5 | 24.3 | 0.06 |
| 48Fe6B12Nd2La32Co | 11.9 | 12.7 | 27.0 | 0.06 |
| 38Fe6B9Nd2Ho45Co | 10.8 | 6.9 | 20.3 | 0.06 |
| 75Fe10B10Nd5Ce reference test | 10.3 | 7.5 | 21.4 | 0.15 |

TABLE 10

| composition at % | Br (kG) | iHc (kOe) | (BH) max (MGOe) |
|---|---|---|---|
| 55Fe9B16Nd20Co | 5.1 | 10.2 | 5.6 |
| 63Fe10B18Nd9Co | 5.3 | 12.7 | 5.8 |
| 58Fe8B12Nd2Gd20Co | 5.4 | 11.7 | 5.4 |
| 55Fe9B16Nd20Co reference test (as-sintered) | 5.0 | 5.7 | 5.0 |
| 63Fe10B18Nd9Co reference test (as-sintered) | 5.1 | 6.4 | 4.9 |

TABLE 11

| Example No. | composition at % | forming: mean particle size | forming: pressing pressure magnetic field | sintering: temp. time | sintering: atmosphere pressure | cooling rate °C./min | aging: temp. (°C.) | aging: time (min) | Br (kG) | iHc (kOe) | (BH) max (MGOe) |
|---|---|---|---|---|---|---|---|---|---|---|---|
| 9 | 73Fe—8B—17Nd—2Ta | 2μm | 1.0ton/cm2 15 kOe | 1120° C. 2 hr | Ar 550 Torr | 600 | reference test (as-sintered) | | 12.2 | 8.7 | 32.4 |
| | | | | | | | 650 | 30 | 12.4 | 10.1 | 34.8 |
| | | | | | | | 650 | 120 | 12.4 | 10.3 | 35.1 |
| | | | | | | | 650 | 240 | 12.4 | 10.6 | 35.2 |
| | | | | | | | 650 | 3000 | 12.3 | 10.5 | 35.1 |
| 13 | 73Fe—9B—16Nd—2Mn | 3μm | 1.0ton/cm2 15 kOe | 1120° C. 2 hr | Ar 600 Torr | 450 | reference test (as-sintered) | | 12.1 | 8.5 | 31.2 |
| | | | | | | | 700 | 30 | 12.5 | 10.2 | 34.6 |
| | | | | | | | 700 | 120 | 12.5 | 10.5 | 35.3 |
| | | | | | | | 700 | 240 | 12.5 | 10.8 | 35.3 |
| | | | | | | | 700 | 3000 | 12.5 | 10.6 | 35.2 |

TABLE 12

| Example No. | composition at % | forming: mean particle size | forming: pressing pressure magnetic field | sintering: temp. time | sintering: atmosphere pressure | cooling rate °C./min | aging: temp. (°C.) | aging: time (min) | Br (kG) | iHc (kOe) | (BH) max (MGOe) |
|---|---|---|---|---|---|---|---|---|---|---|---|
| 10 | 68Fe—15B—12Nd—3Pr—2W | 4μm | 1.0ton/cm2 10 kOe | 1080° C. 1 hr | Ar 450 Torr | 500 | reference test | | | | |
| | | | | | | | 200 | 120 | 9.7 | 6.4 | 19.5 |
| | | | | | | | 450 | 120 | 9.8 | 8.8 | 21.1 |
| | | | | | | | 650 | 120 | 9.8 | 9.0 | 21.0 |
| | | | | | | | 850 | 120 | 9.8 | 9.1 | 22.0 |
| | | | | | | | 950 | 120 | 9.8 | 9.8 | 22.8 |
| | | | | | | | reference test (as-sintered) | | 9.7 | 6.5 | 19.2 |
| 14 | 70Fe—12B—13Nd—3Pr—2Zr | 3μm | 1.0ton/cm2 10 kOe | 1060° C. 1 hr | Ar 450 Torr | 400 | reference test | | | | |
| | | | | | | | 200 | 120 | 9.7 | 6.4 | 19.3 |
| | | | | | | | 450 | 120 | 10.2 | 9.2 | 21.5 |
| | | | | | | | 650 | 120 | 10.2 | 9.4 | 21.6 |
| | | | | | | | 850 | 120 | 10.2 | 9.4 | 22.3 |
| | | | | | | | 950 | 120 | 10.2 | 9.5 | 22.2 |
| | | | | | | | reference test (as sintered) | | 9.7 | 6.5 | 19.2 |

TABLE 13

| Example No. | composition (at %) | forming: mean particle size | forming: pressing pressure magnetic field | sintering: atmosphere pressure | sintering: temp. time | cooling rate °C./min | aging temp. time | Br (kG) | iHc (kOe) | (BH) max (MGOe) |
|---|---|---|---|---|---|---|---|---|---|---|
| 11 | 77Fe8B14Nd1Mo | 1-8μm | 1.0ton/cm2 10 kOe | Ar 250 Torr | 1060° C. 1 hr | 600 | 650° C. 2 hr | 12.3 | 8.9 | 32.4 |
| | 65Fe15B14Nd4Pr2Nb | | | | | | | 11.5 | 9.9 | 30.0 |
| | 67Fe16B10Nd5Gd2V | | | | | | | 10.1 | 6.8 | 21.7 |
| | 72Fe9B8Nd8Ho1Nb1Al | | | | | | | 9.7 | 6.3 | 20.0 |
| | 68Fe14B15Nd1Mo2Al | | | | | | | 7.2 | 6.4 | 11.8 |
| | 73Fe9B16Nd2Cr | | | | | | | 11.5 | 9.2 | 31.0 |
| | 73Fe9B16Nd2Cr | | | | | | | 11.3 | 6.9 | 25.8 |
| | 67Fe16B10Nd5Gd2V (reference) | | | | | | | 10.0 | 4.9 | 17.6 |
| | 68Fe15B15Nd1Mo2Al (reference) | | | | | | | 7.3 | 3.1 | 10.2 |
| 15 | 76Fe8B15Nd1Ti | 1-8μm | 1.2ton/cm2 10 kOe | Ar 250 Torr | 1040° C. 1 hr | 500 | 600° C. 2 hr | 12.4 | 9.2 | 32.8 |
| | 66Fe12B16Nd4Pr2Ni | | | | | | | 11.8 | 10.3 | 30.5 |
| | 68Fe14B12Nd4Gd2Ge | | | | | | | 10.5 | 6.9 | 22.9 |
| | 72Fe9BNd8Ho1Ti1sb | | | | | | | 9.8 | 6.6 | 20.8 |
| | 70Fe12B15Nd1Hf2Bi | | | | | | | 7.4 | 6.5 | 11.9 |
| | 68Fe14B12Nd4Gd2Ge (reference) | | | | | | | 10.2 | 4.5 | 17.0 |
| | 70Fe12B15Nd1Hf2Bi (reference) | | | | | | | 7.4 | 3.0 | 10.1 |

TABLE 14

| Example No. | composition (at %) | forming: mean particle size | forming: pressing pressure magnetic field | sintering: atmosphere pressure | sintering: temp. time | cooling rate °C./min | aging temp. time | Br (kG) | iHc (kOe) | (BH) max (MGOe) |
|---|---|---|---|---|---|---|---|---|---|---|
| 12 | 75Fe10B14Nd1Ta | 2-12μm | 1.7ton/cm2 none | Ar 180 Torr | 1060° C. 1 hr | 650 | 550° C. 8 hr | 6.1 | 10.2 | 6.1 |
| | 70Fe10B16Nd2Ho2W | | | | | | | 6.2 | 10.8 | 6.2 |
| | 76Fe8B12Nd2Ce1Nb1Mo | | | | | | | 6.4 | 9.6 | 6.4 |
| | 75Fe10B14Nd1Ta (reference) | | | | | | | 6.0 | 7.1 | 5.7 |
| | 70Fe10B16Nd2Ho2W (reference) | | | | | | | 6.2 | 7.3 | 5.5 |
| | 75Fe6B18Nd1Cr | | | | | | | 5.6 | 9.8 | 5.8 |
| | 75Fe6B18Nd1Cr (reference) | | | | | | | 5.5 | 6.1 | 5.2 |
| 16 | 74Fe9B16Nd1Ti | 2-15μm | 1.5ton/cm2 none | Ar 200 Torr | 1080° C. 1 hr | 600 | 550° C. 4 hr | 6.3 | 10.6 | 6.4 |
| | 76Fe7B15Nd1Zr1Ni | | | | | | | 6.4 | 10.9 | 6.8 |
| | 74Fe9B13Nd2Ce1HflSn | | | | | | | 6.5 | 9.9 | 6.6 |
| | 74Fe9B16Nd1Ti (reference) | | | | | | | 6.1 | 7.0 | 5.2 |
| | 76Fe7B15Nd1Zr1Ni | | | | | | | 6.2 | 7.1 | 5.3 |

TABLE 14-continued

| Example No. | composition (at %) | forming: mean particle size | forming: pressing pressure magnetic field | sintering: atmosphere pressure | sintering: temp. time | cooling rate °C./min | aging temp. time | Br (kG) | iHc (kOe) | (BH) max (MGOe) |
|---|---|---|---|---|---|---|---|---|---|---|
| | (reference) | | | | | | | | | |

TABLE 15

| Example No. | composition (at %) | forming: mean particle size | forming: pressing pressure, magnetic field | sintering: atmosphere pressure | sintering: temp. time | cooling rate °C./min | aging temp. (°C.) | aging time (min) | Br (kG) | iHc (kOe) | (BH) max (MGOe) | α (%/°C.) |
|---|---|---|---|---|---|---|---|---|---|---|---|---|
| 17 | 61Fe—14Co—7B—16Nd—2Mo | 5μm | 1.5ton/cm2 10 kOe | Ar 200 Torr | 1100° C. 2 hr | 700 | reference (as-sintered) | | 11.1 | 8.1 | 25.1 | 0.085 |
| | | | | | | | 650 | 20 | 11.3 | 10.8 | 27.3 | 0.085 |
| | | | | | | | 650 | 120 | 11.4 | 11.5 | 28.0 | 0.086 |
| | | | | | | | 650 | 240 | 11.4 | 11.6 | 28.1 | 0.086 |
| | | | | | | | 650 | 3000 | 11.4 | 11.8 | 28.1 | 0.086 |
| 21 | 57Fe—15Co—9B—17Nd—2Ti | 4μm | 1.0ton/cm2 15 kOe | Ar 150 Torr | 1120° C. 2 hr | 500 | reference (as-sintered) | | 11.0 | 8.1 | 24.4 | 0.083 |
| | | | | | | | 700 | 20 | 11.5 | 10.7 | 27.8 | 0.083 |
| | | | | | | | 700 | 120 | 11.6 | 12.3 | 28.2 | 0.083 |
| | | | | | | | 700 | 240 | 11.6 | 12.4 | 28.3 | 0.084 |
| | | | | | | | 700 | 3000 | 11.6 | 12.6 | 28.3 | 0.084 |

TABLE 16

| Example No. | composition (at %) | forming: mean particle size | forming: pressing pressure, magnetic field | sintering: atmosphere pressure | sintering: temp. time | cooling rate °C./min | aging temp. (°C.) | aging time (min) | Br (kG) | iHc (kOe) | (BH) max (MGOe) | α (%/°C.) |
|---|---|---|---|---|---|---|---|---|---|---|---|---|
| 18 | 55Fe—15Co—12B—14Nd—2Y—2Nb | 3μm | 1.0ton/cm2 15 kOe | Ar 500 Torr | 1180° C. 2 hr | 450 | reference | | | | | |
| | | | | | | | 200 | 120 | 10.2 | 6.8 | 22.1 | 0.080 |
| | | | | | | | 450 | 120 | 10.4 | 8.5 | 24.7 | 0.081 |
| | | | | | | | 650 | 120 | 10.5 | 8.8 | 25.1 | 0.080 |
| | | | | | | | 850 | 120 | 10.5 | 9.0 | 25.2 | 0.080 |
| | | | | | | | 950 | 120 | 10.5 | 9.1 | 25.4 | 0.080 |
| | | | | | | | reference (as-sintered) | | 10.2 | 6.5 | 21.8 | 0.080 |
| 22 | 55Fe—15Co—10B—16Nd—2Pr—2Hf | 3μm | 1.0ton/cm2 15 kOe | Ar 400 Torr | 1160° C. 4 hr | 450 | reference | | | | | |
| | | | | | | | 200 | 240 | 10.0 | 6.3 | 21.8 | 0.079 |
| | | | | | | | 450 | 240 | 10.5 | 9.6 | 24.9 | 0.080 |
| | | | | | | | 650 | 240 | 10.6 | 9.8 | 25.3 | 0.079 |
| | | | | | | | 850 | 240 | 10.6 | 9.6 | 25.5 | 0.079 |
| | | | | | | | 950 | 240 | 10.6 | 9.5 | 25.6 | 0.079 |
| | | | | | | | reference (as-sintered) | | 10.0 | 6.2 | 21.6 | 0.079 |

TABLE 17

| Example No. | composition (at %) | forming: mean particle size | forming: pressing pressure magnetic field | sintering: atmosphere pressure | sintering: temp. time | cooling rate °C./min | aging temp. time | Br (kG) | iHc (kOe) | (BH) max (MGOe) | α (%/°C.) |
|---|---|---|---|---|---|---|---|---|---|---|---|
| 19 | 63Fe5Co12B18Nd2Ta | 2–15μm | 1.8ton/cm2 10 kOe | Ar 250 Torr | 1080° C. 2 hr | 700 | 700° C. 4 hr | 12.4 | 8.6 | 34.5 | 0.07 |
| | 56Fe20Co8B7Nd7Pr2W | | | | | | | 10.7 | 7.9 | 24.8 | 0.04 |
| | 66Fe8Co8B12Nd6Tb1V | | | | | | | 12.0 | 8.1 | 29.9 | 0.06 |
| | 67Fe10Co6B15Nd2Al | | | | | | | 12.2 | 12.0 | 32.5 | 0.06 |
| | 77Fe5Co6B9Nd2Ho1Al | | | | | | | 10.2 | 7.2 | 23.1 | 0.08 |
| | 74Fe9B10Nd6Ce1V* | | | | | | | 10.3 | 7.6 | 22.8 | 0.16 |
| | 65Fe8Co6B20Nd1Cr | | | | | | | 10.8 | 9.2 | 25.2 | 0.08 |
| | 73Fe6B20Nd1Cr* | | | | | | | 10.7 | 8.5 | 24.9 | 0.12 |
| 23 | 64Fe8Co10B16Nd2Mn | 2–10μm | 1.5ton/cm2 10 kOe | Ar 200 Torr | 1060° C. 2 hr | 650 | 650° C. 4 hr | 12.6 | 9.3 | 34.5 | 0.06 |
| | 66Fe10Co8B7Nd7Pr2Ni | | | | | | | 10.8 | 8.6 | 25.4 | 0.06 |
| | 63Fe8Co9B12Nd7Tb1Ge | | | | | | | 12.2 | 8.5 | 30.2 | 0.06 |
| | 59Fe15Co6B18Nd2Sn | | | | | | | 12.3 | 12.2 | 32.9 | 0.05 |
| | 71Fe9Co6B9Nd4Ho1Sb | | | | | | | 10.4 | 7.4 | 25.2 | 0.07 |
| | 72Fe10B16Nd2Mn* | | | | | | | 11.0 | 8.4 | 23.0 | 0.15 |

*reference test

TABLE 18

| Example No. | composition (at %) | forming: mean particle size | forming: pressing pressure, magnetic field | sintering: atmosphere pressure | sintering: temp. time | cooling rate °C./min | aging temp. time | Br (kG) | iHc (kOe) | (BH) max (MGOe) |
|---|---|---|---|---|---|---|---|---|---|---|
| 20 | 53Fe15Co12B18Nd2Ta | 1-10$^{\mu m}$ | 1.0$^{ton/cm2}$ | Ar | 1020° C. | 550 | 600° C. | 6.0 | 9.6 | 8.3 |
| | 60Fe10Co10B15Nd2Ho3Al | | none | 150 Torr | 1 hr | | 4 hr | 5.7 | 8.1 | 7.9 |
| | 49Fe25Co8B12Nd4Gd2V | | | | | | | 5.1 | 9.0 | 7.5 |
| | 53Fe15Co12B18Nd2Ta* | | | | | | | 5.2 | 6.1 | 7.7 |
| | 60Fe10Co10B15Nd2Ho3Al* | | | | | | | 5.1 | 5.8 | 7.6 |
| | 54Fe10Co14B20Nd2Cr* | | | | | | | 4.8 | 9.7 | 4.6 |
| | 54Fe10Co14B20Nd2Cr | | | | | | | 4.7 | 4.9 | 4.3 |
| 24 | 55Fe16Co10B17Nd2Zr | 2-10$^{\mu m}$ | 1.5$^{ton/cm2}$ | Ar | 1040° C. | 450 | 650° C. | 6.2 | 10.3 | 8.4 |
| | 49Fe20Co8B16Nd4Ho3Ni | | none | 150 Torr | 1 hr | | 4 hr | 6.0 | 8.6 | 8.0 |
| | 48Fe25Co9B14Nd2Gd2Bi | | | | | | | 5.6 | 9.5 | 7.7 |
| | 55Fe16Co17Nd2Zr* | | | | | | | 5.4 | 5.3 | 7.0 |
| | 49Fe10Co8B16Nd2Ho3Ni* | | | | | | | 5.3 | 5.4 | 6.7 |

*reference test

We claim:

1. A process of producing a permanent magnet of the Fe-B-R type comprising:

providing a sintered body having a composition consisting essentially of, by atomic percent, 12–24% R wherein R is at least one element selected from the group consisting of Nd, Pr, La, Ce, Tb, Dy, Ho, Er, Eu, Sm, Gd, Pm, Tm, Yb, Lu and Y and at least 50% of R consists of Nd and/or Pr, 4–24% B, and at least 52% Fe, and heat-treating the sintered body at a temperature ranging from 350 degrees C. to the sintering temperature in a non-oxidizing atmosphere for at least 5 minutes to increase the intrinsic coercivity of the sintered body.

2. A process as defined in claim 1, in which Co is substituted for Fe in an amount greater than zero and not exceeding 45 atomic percent of the sintered body.

3. A process as defined in claim 1, wherein said composition comprises at least one of additional elements M of no more than the values by atomic percent as specified hereinbelow provided that, when two or more elements M are added, the total amount thereof shall be no more than the largest value among said specified values of the elements actually added:

3.5% Ti,
2.0% Ni,
3.0% Bi,
6.5% V,
8.5% Nb,
8.5% Ta,
4.5% Cr,
5.5% Mo,
5.5% W,
4.0% Mn,
5.5% Al,
0.5% Sb,
4.0% Ge,
1.0% Sn,
3.5% Zr, and
3.5% Hf.

4. A process as defined in claim 3, in which Co is substituted for Fe in an amount greater than zero and not exceeding 45 atomic percent of the sintered body.

5. A process as defined in any one of claims 1–4, wherein the step of providing said sintered body comprises:

preparing a metallic powder having said composition and a mean particle size of 0.3–80 microns, compacting said metallic powder in a magnetic field, and sintering the compacted body at a temperature of 900–1200 degrees C. in a nonoxidizing or reducing atmosphere for at least 5 minutes; and wherein the resultant magnet has a maximum energy product of at least 10 MGOe.

6. A process as defined in any one of claims 1–4, wherein the step of providing said sintered body comprises:

preparing a metallic powder having a mean particle size of 0.3–80 microns and a composition consisting essentially of, by atomic percent, 12–20% R, 5–18% B, and at least 62% Fe, compacting said metallic powder without applying a magnetic field, and sintering the compacted body at a temperature of 900–1200 degrees C. in a nonoxidizing or reducing atmosphere for at least 5 minutes; and wherein the resultant magnet has a maximum energy product of at least 4 MGOe.

7. A process as defined in any one of claims 1–4, wherein the heat-treating is carried out after cooling following the sintering.

8. A process as defined in any one of claims 1–4, wherein the heat-treating is carried out immediately following the sintering.

9. A process as defined in claim 7, wherein the cooling following the sintering is carried out at a cooling rate of 20 degrees C./min or higher.

10. A process as defined in any one of claims 1–4, wherein heat-treating is carried out at least at one stage.

11. A process as defined in claim 10, wherein heat-treating is carried out in two or more stages.

12. A process as defined in any one of claims 1–4, wherein the heat-treating is carried out by cooling the sintered body at a cooling rate of 0.2–20 degrees C./min from 800 to 400 degrees C.

13. A process as defined in claim 11, wherein heat-treating at a subsequent stage following a preceding stage is carried out at a temperature lower than that of the preceding stage.

14. A process as defined in claim 11, wherein the heat-treating at the first stage is carried out at a temperature of 800 degrees C. or higher.

15. A process as defined in claim 13, wherein the heat-treating at a second or further stage is carried out at a temperature of 800 degrees C. or less.

16. A process as defined in claim 12, wherein said cooling procedure is carried out subsequent to the sintering or any preceding heat-treating stage.

17. A process as defined in claim 1, wherein the heat-treating is carried out in a vacuum, or a reducing or inert atmosphere.

18. A process as defined in claims 5 or 6, wherein the nonoxidizing or reducing atmosphere for sintering is comprised of a vacuum, an inert gas or a reducing gas.

19. A process as defined in claim 5 or 6, wherein the metallic powder is an alloy powder having said respective composition.

20. A process as defined in claim 5 or 6, wherein the metallic powder is a mixture of alloy powders making up said respective composition.

21. A process as defined in claim 5 or 6, wherein the metallic powder is a mixture of an alloy or alloys having a Fe-B-R base composition and a powdery metal having a complementary composition making up the respective final composition of said metallic powder.

22. A process as defined in claim 21, wherein said powdery metal comprises an alloy or alloys of the componental elements of said final composition.

23. A process as defined in claim 21, wherein said powdery metal comprises a componental elements of said final composition.

24. A process as defined in claim 9, wherein the cooling rate is 100 degrees C./min or higher.

25. A process as defined in claim 2 or 4, wherein Co is no more than 35%.

26. A process as defined in claim 2 or 4, wherein Co is no more than 25%.

27. A process as defined in claim 2 or 4, wherein Co is 5% or more.

28. A process as defined in claim 6, wherein R is 12–16% and B is 6–18% and wherein the magnet has a maximum energy product of at least 7 MGOe.

29. A process as defined in claim 3, wherein the additional element M comprises at least one selected from the group consisting of V, Nb, Ta, Mo, W, Cr and Al.

30. A process as defined in claim 10, wherein the heat-treating is carried out at a temperature between 450 and 800 degrees C.

31. A process as defined claim 30, wherein the heat-treating is carried out at a temperature between 500 and 700 degrees C.

32. A process as defined in claim 10, wherein the heat-treating is carried out approximately under an isothermic condition at each stage.

33. A process as defined in claim 24, wherein the sintered body is cooled down to temperature of 800 degrees C. or less.

34. A product which is produced by the process as defined in claim 5.

35. A product which is produced by the process as defined in claim 6.

36. A process as defined in any one of claims 1–4, wherein Si does not exceed 5 atomic percent.

37. A process as defined in claims 1 or 3, wherein at least 50 vol percent of the sintered body is occupied by ferromagnetic FeBR type compound having a tetragonal crystal structure.

38. A process as defined in claims 2 or 4, wherein at least 50 vol percent of the sintered body is occupied by ferromagnetic FeCoBR type compound having a tetragonal crystal structure.

* * * * *

Disclaimer 4,601,875—*Hitoshi Yamamoto, Osaka; Masato Sagawa, Nagoakakyo; Setsuo Fujimura, Kyoto; Yutaka Matsuura, Ibaraki*, all of Japan. PROCESS FOR PRODUCING MAGNETIC MATERIALS. Patent dated July 22, 1986, by the assignee, Sumitomo Special Metals Co., Ltd.

Hereby enters this disclaimer to claims 34 and 35 of said patent.

*[ Official Gazette November 5, 1991. ]*